United States Patent [19]

Germi et al.

[11] Patent Number: 4,610,375

[45] Date of Patent: Sep. 9, 1986

[54] REFRIGERATOR DOOR WITH DRINK DISPENSER

[75] Inventors: Franco Germi, Gavirate; Franco Moretti, Varese, both of Italy

[73] Assignee: U.S. Philips Corporation, New York, N.Y.

[21] Appl. No.: 677,702

[22] Filed: Dec. 4, 1984

[30] Foreign Application Priority Data

Dec. 6, 1983 [IT] Italy ..... 23764/83[U]

[51] Int. Cl.[4] ..... B67D 5/62; F25D 23/12

[52] U.S. Cl. ..... 222/131; 222/146.6; 222/513; 222/517; 222/527; 62/338; 312/138 A

[58] Field of Search ..... 62/338; 222/131, 146.6, 222/505, 508, 511, 517, 526, 527, 533, 534; 312/138 A

[56] References Cited

U.S. PATENT DOCUMENTS

| | | | |
|---|---|---|---|
| 1,953,200 | 4/1934 | Thomas | 222/536 |
| 2,078,097 | 4/1937 | Radzinsky | 62/338 |
| 2,126,491 | 8/1938 | McCartha | 62/338 |
| 2,786,606 | 3/1957 | Dushek et al. | 222/534 |
| 2,973,124 | 2/1961 | Reese | 222/527 |
| 3,208,641 | 9/1965 | Brugioni | 222/108 |

*Primary Examiner*—Joseph J. Rolla
*Assistant Examiner*—Frederick R. Handren
*Attorney, Agent, or Firm*—Rolf E. Schneider

[57] ABSTRACT

A refrigerator door comprises an inner panel and an outer panel forming the wall of the door and has a drink container removably associated with the inner panel. A drink-delivery tube communicates with the interior of the container and is hingedly movable against a resilient bias from an inoperative position to a delivery position, the tube extending through the wall of the door and terminating in a spout. A slide is associated with the tube for effecting such movement thereof and is movable from the outside of the door in a vertical opening formed in the outer panel of the door wall. A compartment accessible from the outside of the door without opening the same is provided in the door, the compartment being divided into a lower compartment for placement of a cup and an upper compartment for reception of the tube spout. A pivotal partition controllable by the slide separates the lower compartment from the upper compartment.

4 Claims, 6 Drawing Figures

REFRIGERATOR DOOR WITH DRINK DISPENSER

Figure 1:
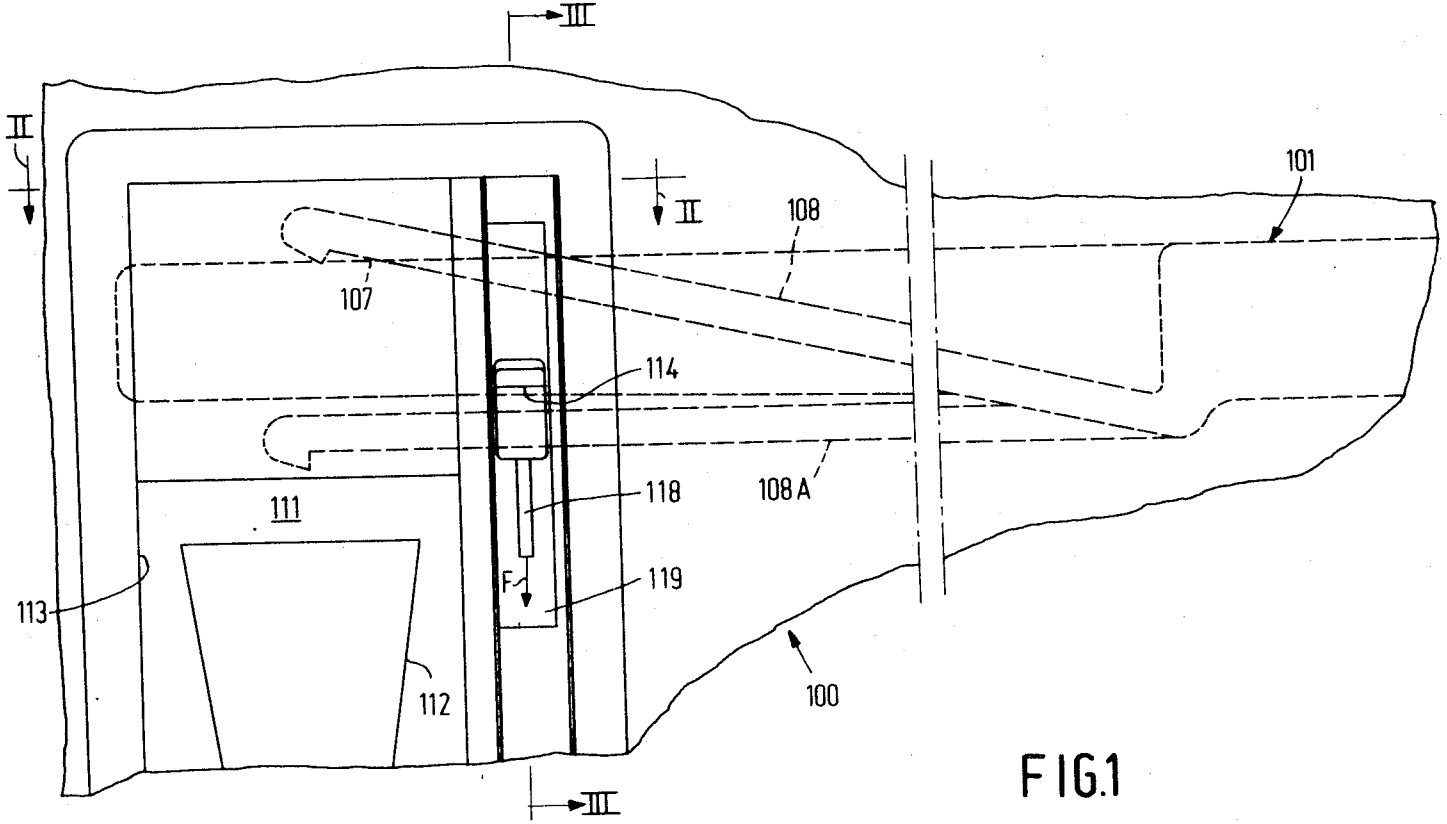

This invention relates to a refrigerator door provided with a drink dispenser, inner and outer panels forming the wall of the door, the drink dispenser comprising a container which is removably arranged on or associated with the inner panel and which has delivery means for the drink.

The invention also relates to a drink dispenser for use in such a refrigerator door.

A refrigerator door with a drink dispenser is known from U.S. Pat. No. 3,208,641. This known refrigerator door comprises a compartment which is accessible from the outside of the refrigerator without opening the door and in which a cup or glass can be placed underneath a conventional tap of a drink dispenser. The drink dispenser itself is placed on a shelf at the inner side of the door. A disadvantage of this conventional tap is that it is difficult to clean, especially if the drink contains sugar or other syrup-like solutions. In the long term these taps also become unreliable due to the formation of deposits between movable and sealing parts.

The object of the present invention is to provide a refrigerator door provided with a drink, which dispenser is very easy to clean, reliable and simple in operation and inexpensive to manufacture.

According to the invention there is provided a refrigerator door having a drink dispenser, of the type described above characterized in that the delivery means comprises a pipe or a tube which communicates with the interior of the container and which is hingedly movable against a resilient bias from an inoperative position to a delivery position by means of a slide located in the refrigerator door.

In order to facilitate the use of such a drink dispenser, an embodiment of the invention is characterized in that the door has a compartment which is accessible from the outside of the refrigerator without opening the door, and the pipe of the drink dispenser extends through the wall of the door and terminates in a spout located in said compartment, the slide being connected to the pipe and being slidable in an opening in the wall of the door, and the slide having a control button operable from the outside of the door and slidable in a slot in the door.

In order to reduce leakage of cold from the inside of the refrigerator through the compartment to the outside, the compartment is divided into a lower compartment in which a cup can be placed and an upper compartment in which the spout of the pipe is located, said upper and lower compartments being separated from each other by a pivotal partition which is controlled by said slide. When the button is moved to the delivery position the partition between the upper and lower compartments is automatically pivoted to an open position to allow the spout of the pipe to move into the delivery position above the cup placed in the lower compartment. When the button is released the partition automatically closes the upper compartment and reduces leakage of cold in this way.

In one embodiment the resilient bias is provided by a spring connected between the pipe and the container.

In another embodiment the resilient bias is provided by the inherent resilience of the constituent material of the pipe.

In a further embodiment the container includes an outlet duct which is integral with the container and to which the pipe is hingedly connected by a sleeve of an elastic material.

Figure 2:
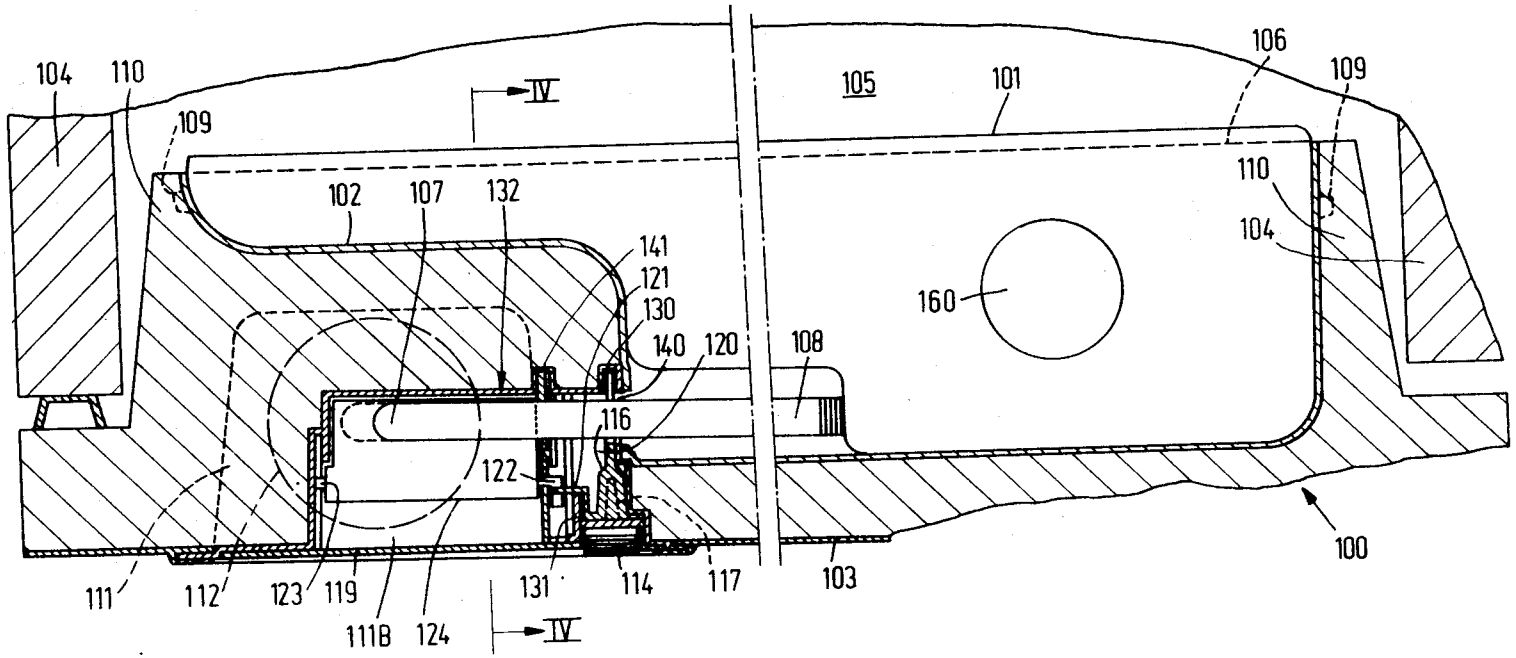
Figure 3:
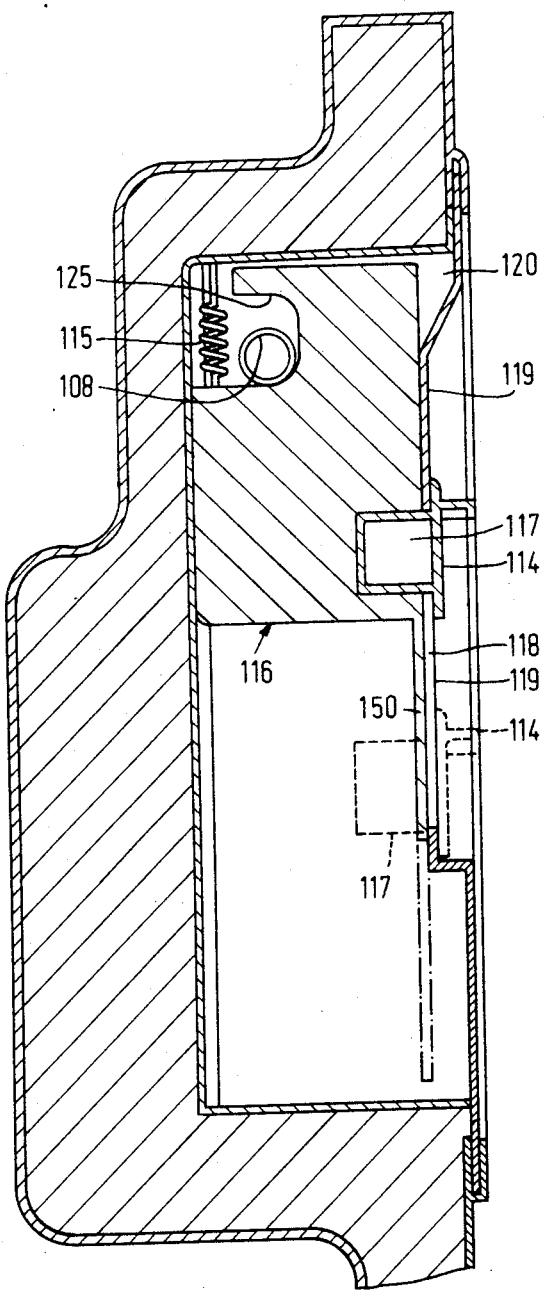
Figure 4:
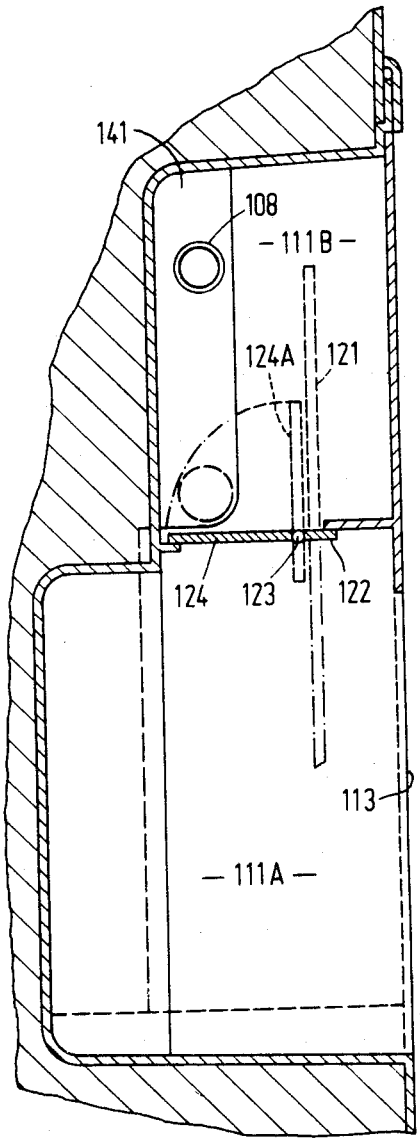
Figure 5:
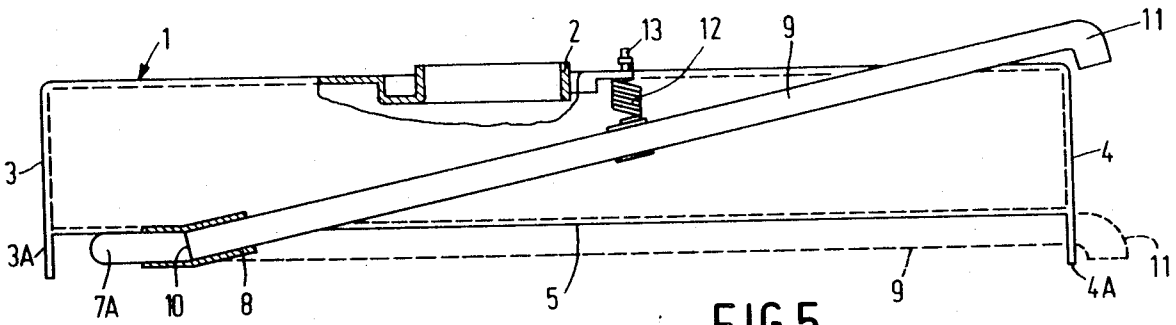
Figure 6:
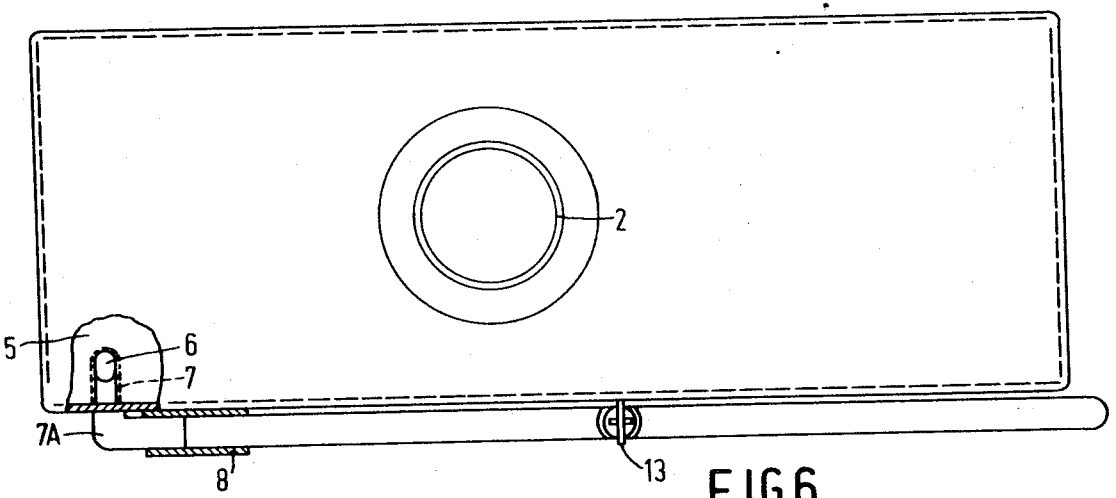

The invention will now be described with reference to the accompanying drawings, in which:

FIG. 1 is a partial diagrammatic front view of a domestic refrigerator door incorporating a drink dispenser which is operated by moving a slide associated with the door, FIG. 2 is a sectional plan view taken on the line II—II of FIG. 1, FIG. 3 is a sectional elevational view taken on the line III—III of FIG. 1, FIG. 4 is a sectional elevational view taken on the line IV—IV of FIG. 2, FIG. 5 is a partly sectional front view of a drink container and hinged delivery pipe, and FIG. 6 is a plan view of the container and delivery pipe shown in FIG. 5.

In FIGS. 1 to 4, the reference numeral 100 indicates a refrigerator door, 101 a drink container and 108 a delivery pipe or tube which is hingedly connected at one end to said container and which, either by its inherent resilience or by the action of a spring or other elastic means between the container and the pipe, tends to assume a raised inoperative position. The refrigerator door comprises inner and outer panels 102 and 103, between which an insulating material is disposed. The container 101 rests on a shelf 106 formed on the inner side of the refrigerator door 100. Reference numeral 104 indicates the side walls of the refrigerator casing and 105 the refrigeration compartment.

In order to removably retain the container on the shelf 106, it is provided at its end with bosses or projections 109 which, by virtue of the elastic deformability of the materials used, engage in corresponding seats provided in shoulders 110 at the ends of the shelf 106.

In the front of the door there is provided a compartment 111 which has an opening 113 at the front through which the user can insert a cup 112 into the compartment 111 to be filled with drink from the container 101. To one side of the front opening 113 of the compartment 111 there is provided on the front of the door a button 114 which can be slid downwards by the user in the direction of the arrow F. A slide 116 slidable in vertical guides 130 and 131 is formed with a recess 125 in which the face end of the pipe 108 is located in such a way that this end is retained between the upper and lower edges of the recess. The button 114 includes a projection 117 which is fixed in a recess in the slide 116. The inherent resilience of the pipe 108 or the action of a return spring which acts directly on the pipe 108, as the case may be, opposes the downward movement of the button 114. Additionally a further return spring 115 may be arranged to act between the slide and the wall of the door (see FIG. 3). The projection 117 extends through a vertical slot 118 in a profiled indicator plate 119 which closes a compartment 120 in which the slide 116 is vertically movable, this compartment being provided in the door adjacent the compartment 111 for the cup.

Since container 108 is supported on the inner side of the door and the drink is delivered at the outside, the hinged delivery pipe extends through an opening in the insulated wall of the door, with the result that leakage of cold takes place. In order to reduce this cold leakage, compartment 111 is divided into a lower compartment 111A, in which a cup can be placed, and an upper compartment 111B, in which the spout 107 of the pipe 108 is located, by means of a pivotal partition 124 (see FIG. 4). Extending down one side of the slide 116 is a lug 121 which co-operates with a radial projection 122 on the pivot spindle 123 of the pivotal partition 124. When the slide 116 is moved downwards by means of the button 114, the pipe 108 is swung down into its lowered delivery position (shown by the broken lines 108A in FIG. 1). During this movement of the slide 116 the lug 121 pivots the partition 124 into its open position (shown by the broken lines 124A in FIG. 4), which position is reached before the pipe 108 reaches the path of movement of the edge of the partition. After delivery of the drink, the button 114 is released and the partition, the slide 116 and the pipe 108 return to their initial positions.

The guides 130 and 131 for the slide 116 are formed by part of a profiled member 132, which may comprise a plurality of parts and which at least partly defines the compartments 111 and 120, and by part of the indicator plate 119 respectively. The spindle 123 of the partition 124 is rotatably supported in the member 132. The inner panel 102 and the member 132 include openings 140 and 141 through which the pipe 108 passes. The slide 116 is formed at its front end with a downwardly directed tab 150 which closes the slot 118 in which the projection 117 of the button 114 moves.

The reference numeral 160 indicates a cap which closes the filling aperture of the container 101.

In FIGS. 5 and 6 a drink container and delivery pipe are shown more in detail. The container 1 is of parallelepiped form and is preferably constructed of a plastic by known methods. On its upper wall, the container 1 has a filling aperture 2, which may be threaded to receive a threaded cap provided with an air compensation hole or valve to allow air to enter the container above the liquid therein. The end side walls 3, 4 of the container are deeper than the other two vertical walls so that the end walls 3, 4 have projecting portions 3A, 4A which form two supports to keep the bottom 5 of the container 1 raised above the surface on which the container rests.

In its bottom wall the container has an outlet aperture 6 communicating with an outlet duct 7 which is either fixed rigidly to or formed integrally with the container. The duct 7 extends beyond the front wall of the container 1 with a tubular part 7A which has a right angle and on which there is mounted a sleeve 8 of an elastic material which acts as a connector for a delivery pipe 9. The sleeve constitutes a hinge for the pipe 9. The inlet end 10 of the pipe 9 thus communicates with the interior of the container 1. The downwardly directed discharge end or spout 11 of the pipe is maintained above the maximum liquid level in the container by a tension spring 12, which at one end is hooked to a lug 13 which projects forwards from the front wall of the container 1, and at the other end is hooked to or embraces the pipe 9 at a point intermediate the ends thereof.

The invention also covers an embodiment in which the pipe 9 is formed from a plastic material integrally with the projecting part 7A of the outlet duct 7, thus enabling the connecting sleeve 8 to be dispensed with. When made of a plastic material the pipe 9 may be given an inherent resilience which allows it to hinge from the raised inoperative position to a delivery position, and which also biasses the pipe to the inoperative position, thus enabling the return spring 12 to be dispensed with.

The drink is delivered when the user depresses the pipe 9 against the action of the spring 12 into a position (for example, the position shown in broken lines in FIG. 5) in which the discharge end of the pipe is below the level of the drink in the container 1. Drink will then flow from the outlet of the pipe 9. When released the pipe 9 rises to the inoperative position under the action of the spring 12 and delivery ceases.

In FIGS. 1 to 4 an example is given in which the drink can be obtained via a compartment in a refrigerator door without opening the door. It will be clear that a drink dispenser as shown in FIGS. 5 and 6 can also be used in a refrigerator door in such a way that the drink is obtained after opening the door, i.e. from the inside of the door. In that case a slide for depressing the pipe can be arranged on the inner panel of the door.

What is claimed is:

1. A refrigerator door which comprises an inner panel and an outer panel forming the wall of the door; a drink container removably associated with the inner panel; a drink-delivery tube communicating with the interior of the container, said tube being hingedly movable against a resilient bias from an inoperative position to a delivery position, the tube extending through the wall of the door and terminating in a spout; a slide associated with said tube for effecting said movement thereof and being movable from the outside of the door in a vertical opening formed in the outer panel of the door wall; a compartment in said door accessible from the outside of the door without opening the same, said compartment being divided into a lower compartment for placement of a cup and an upper compartment for reception of the tube spout; and a pivotal partition controllable by the slide and separating the lower compartment from the upper compartment.

2. A refrigerator door according to claim 1, in which the resilient bias is provided by a spring connected between the tube and the container.

3. A refrigerator door according to claim 1, in which the resilient bias is provided by the inherent elasticity of the constituent material of the tube.

4. A refrigerator door according to claim 1, in which the container is provided with an integral outlet duct hingedly connected to the tube by a sleeve of an elastic material.

* * * * *